US012584420B2

(12) United States Patent
Ortiz Neri et al.

(10) Patent No.: US 12,584,420 B2
(45) Date of Patent: Mar. 24, 2026

(54) CLOSED-LOOP COOLING FLUID CIRCUIT FOR MAGNETIC BEARINGS OF AN EXPANDER-COMPRESSOR SYSTEM

(71) Applicant: Nuovo Pignone Tecnologie-S.r.l., Florence (IT)

(72) Inventors: Massimiliano Ortiz Neri, Florence (IT); Francesco Cangioli, Florence (IT); Davide Biliotti, Florence (IT); Duccio Fioravanti, Florence (IT)

(73) Assignee: Nuovo Pignone Tecnologie—S.r.l., Florence (IT)

( * ) Notice: Subject to any disclaimer, the term of this patent is extended or adjusted under 35 U.S.C. 154(b) by 0 days.

(21) Appl. No.: 18/700,953

(22) PCT Filed: Oct. 12, 2022

(86) PCT No.: PCT/EP2022/025471
§ 371 (c)(1),
(2) Date: Apr. 12, 2024

(87) PCT Pub. No.: WO2023/066518
PCT Pub. Date: Apr. 27, 2023

(65) Prior Publication Data

US 2025/0003425 A1 Jan. 2, 2025

(30) Foreign Application Priority Data

Oct. 19, 2021 (IT) ..... 102021000026741

(51) Int. Cl.
*F01D 25/12* (2006.01)
*F01D 25/16* (2006.01)
(Continued)

(52) U.S. Cl.
CPC ..... *F01D 25/125* (2013.01); *F04D 29/048* (2013.01); *F04D 29/124* (2013.01); *F04D 29/128* (2013.01); *F01D 25/168* (2013.01)

(58) Field of Classification Search
CPC .. F01D 25/168; F04D 29/048; F04D 29/0513; F04D 29/124; F04D 29/128; F04D 29/5873
See application file for complete search history.

(56) References Cited

U.S. PATENT DOCUMENTS 4,993,917 A * 2/1991 Kulle ..... F04D 29/124 415/105
5,755,556 A 5/1998 Hultgren et al.
(Continued)

FOREIGN PATENT DOCUMENTS

EP 0 317 946 A2 5/1989
EP 1 905 948 A1 4/2008
(Continued)

OTHER PUBLICATIONS

JP H057-1533 (machine translation), published Mar. 23, 1993 (Year: 1993).*
(Continued)

*Primary Examiner* — Nathaniel E Wiehe
*Assistant Examiner* — Jason G Davis
(74) *Attorney, Agent, or Firm* — Paul Frank + Collins P.C.

(57) ABSTRACT

An expander-compressor system comprising an expander, a compressor and a shaft located in a casing which mechanically couples the expander and the compressor; the expander-compressor system comprises further a magnetic bearing which is positioned inside the casing and is arranged to act on the shaft. The magnetic bearing is cooled by a cooling fluid circuit arranged in a closed-loop configuration
(Continued)

in order to avoid the release of cooling fluid to the environment and reduce the amount of cooling fluid required for cooling the one magnetic bearing. The expander-compressor system comprises further at least one dry gas seal arranged at the casing around a first end of the shaft and/or a second end of the shaft in order to avoid leakage of process gas to the cooling fluid circuit at the shaft. The cooling fluid circuit comprises pump or a blower, that may be internal and/or external to the casing.

15 Claims, 7 Drawing Sheets

(51) Int. Cl.
*F04D 29/048* (2006.01)
*F04D 29/12* (2006.01)

(56) References Cited

U.S. PATENT DOCUMENTS

| | | | | |
|---|---|---|---|---|
| 9,234,522 | B2 * | 1/2016 | Jonsson | F16C 32/0476 |
| 10,030,672 | B2 * | 7/2018 | Gilarranz | F04D 29/584 |
| 10,151,316 | B2 | 12/2018 | Camatti et al. | |
| 10,801,549 | B2 * | 10/2020 | Ertas | F01D 25/168 |
| 2007/0101755 | A1 | 5/2007 | Kikuchi et al. | |
| 2012/0107143 | A1 | 5/2012 | Gilarranz et al. | |
| 2013/0170943 | A1 | 7/2013 | Jonsson et al. | |
| 2018/0328210 | A1 * | 11/2018 | Moll | F01D 11/06 |
| 2019/0041124 | A1 | 2/2019 | Berti et al. | |
| 2019/0063257 | A1 | 2/2019 | Fioravanti et al. | |
| 2019/0331027 | A1 | 10/2019 | Fairman | |
| 2019/0368549 | A1 | 12/2019 | Ertas et al. | |

FOREIGN PATENT DOCUMENTS

| | | | |
|---|---|---|---|
| EP | 2 447 539 | A2 | 5/2012 |
| EP | 3 450 701 | A1 | 3/2019 |
| EP | 3 467 402 | A1 | 4/2019 |
| JP | H05 71533 | A | 3/1993 |
| JP | H11325092 | A | 11/1999 |
| JP | 2016522372 | A | 7/2016 |
| JP | 2017219246 | A | 12/2017 |
| WO | 2017050445 | A1 | 3/2017 |
| WO | 2017/153387 | A1 | 9/2017 |

OTHER PUBLICATIONS

Atlas Copco Gas and Process Solutions, "Driving Expander Technology".
Cryostar, "Ecochill".

* cited by examiner

CLOSED-LOOP COOLING FLUID CIRCUIT FOR MAGNETIC BEARINGS OF AN EXPANDER-COMPRESSOR SYSTEM

TECHNICAL FIELD

The subject-matter disclosed herein relates to a expander-compressor system comprising a cooling fluid circuit for cooling one or more magnetic bearings of the system.

BACKGROUND ART

Magnetic bearings are largely used for controlling the position of a rotor of a machine on which the magnetic bearing is installed due to several advantages including very low and predictable friction and the ability to run without lubrication and in vacuum. Typically, magnetic bearings are used in industrial machines such as compressors, turbines, pumps, motors and generators.

In particular, magnetic bearings can be Active Magnetic Bearing (=AMB) or Passive Magnetic Bearing (=PMB). A passive magnetic bearing uses permanent magnets to generate magnetic levitation; however, passive magnetic bearings are difficult to design. As a result, most magnetic bearings are active magnetic bearings.

In general, an active magnetic bearing is an electro-magnetic system which has a stator with several electro-magnets positioned around a rotor, which is typically coupled to a shaft; the electro-magnets of the stator generate attracting forces on the rotor in order to maintain the position of the rotor relative to the stator.

Rotating machines, such as compressors or expanders, which use active magnetic bearing are well known; for example, international patent application WO2017050445A1 discloses a turbomachine system, in particular a turbine stage, provided with an active magnetic bearing and a cooling system (in an open-loop configuration) in order to dissipate heat in the magnetic bearing. The so-called "instrument air", which is an extremely clean supply of compressed air free from contaminates (such as moisture and particulates) and is typically easily procurable and available in industrial plants (for example for pneumatic equipment or valve actuation), may be used as cooling fluid in the cooling system; instrument air enters the cooling system at low temperature, cools the magnetic bearings and then is discharged at higher temperature.

However, it is desirable to consume as less cooling fluid as possible. From European patent application EP3450701A1 is known a cooling system in a closed-loop configuration to cool down active magnetic bearings of a turbomachine system, in particular a compressor or pump or turbine or turbo-expander.

It is to be noted that known cooling systems include an external blower or an additional impeller installed on the shaft of the rotating machine (outside of the casing of the machine) to circulate the cooling fluid.

SUMMARY

It would be desirable to have an expander-compressor system with at least one magnetic bearing and a cooling fluid circuit to cool the at least one magnetic bearing having small consumption of cooling fluid.

According to an aspect, the subject-matter disclosed herein relates to an expander-compressor system having an expander and a compressor working with a process gas (which may be the same process gas or different process gas) and a shaft that mechanically couples the expander and the compressor and that is positioned inside a casing. The expander-compressor system has further a magnetic bearing arranged to act on the shaft, and a cooling fluid circuit arranged in a closed-loop configuration and configured to cool the magnetic bearing through circulation of a cooling fluid. The cooling fluid circuit comprises a heat exchanger configured to remove heat from the cooling fluid. The magnetic bearing is positioned inside the casing while the heat exchanger is positioned outside the casing. The expander-compressor system has further at least one dry gas seal (=DGS), preferably two dry gas seals, configured to avoid leakage of process gas to the cooling fluid circuit.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
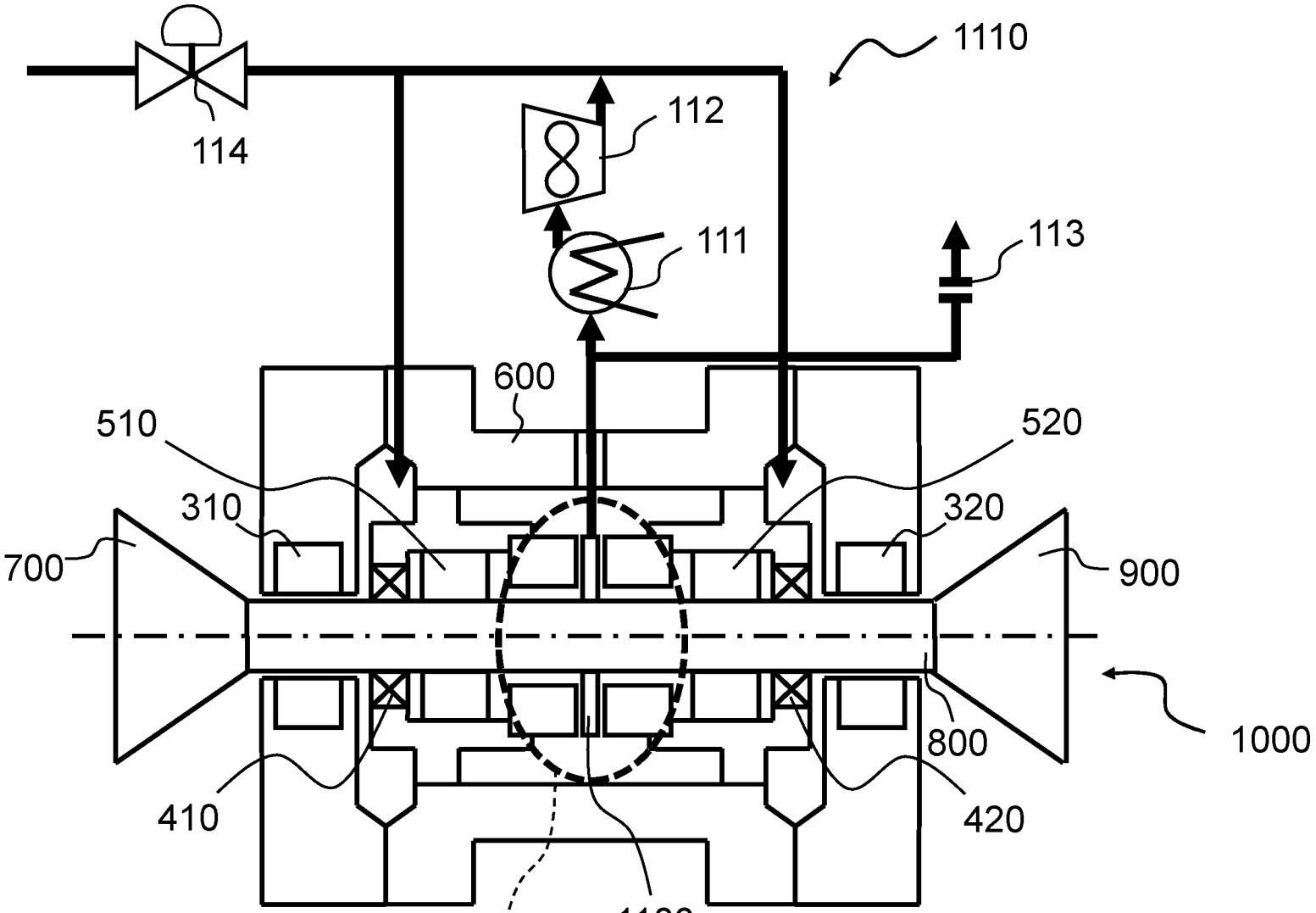
FIG. 1 shows a simplified cross-sectional view of a first embodiment of an innovative expander-compressor system wherein an external part of a cooling fluid circuit is highlighted.

The subject-matter disclosed herein relates to an innovative expander-compressor system, i.e. typically a compressor and an expander connected by a common shaft and configured to process at least a process fluid, having at least one magnetic bearing, i.e. a device that allows unimpeded rotation thanks to opposed magnets that keep rotating parts slightly spaced from fixed parts. The innovative expander-compressor system is provided with a cooling fluid circuit, in which flows a cooling fluid in order to cool the magnetic bearing, which tends to heat up during work. The cooling fluid circuit is arranged in a closed-loop configuration in order to recirculate the fluid and avoid the release thereof to the environment, reducing therefore the amount of cooling fluid required for cooling the magnetic bearing. The expander-compressor system comprises further at least one dry gas seal (=DGS), preferably two dry gas seals, configured to avoid leakage of process gas to the cooling fluid circuit. The cooling fluid circuit comprises a pump or a blower to circulate the cooling fluid in the cooling fluid circuit and a heat exchanger to remove heat from the cooling fluid, such that the cooling fluid enters into a casing of the expander-compressor system, cools the magnetic bearing, exits from the casing, is cooled by the heat exchanger and then returns to the casing. The cooling fluid circuit comprises further a valve, for selectively feed the cooling fluid to the cooling fluid circuit, and a vent, to remove gases leaked in the cooling fluid circuit.

Reference now will be made in detail to embodiments of the disclosure, an example of which is illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. In the following description, similar reference numerals are used for the illustration of figures of the embodiments to indicate elements performing the same or similar functions. Moreover, for clarity of illustration, some references may be not repeated in all the figures.

Figure 2:
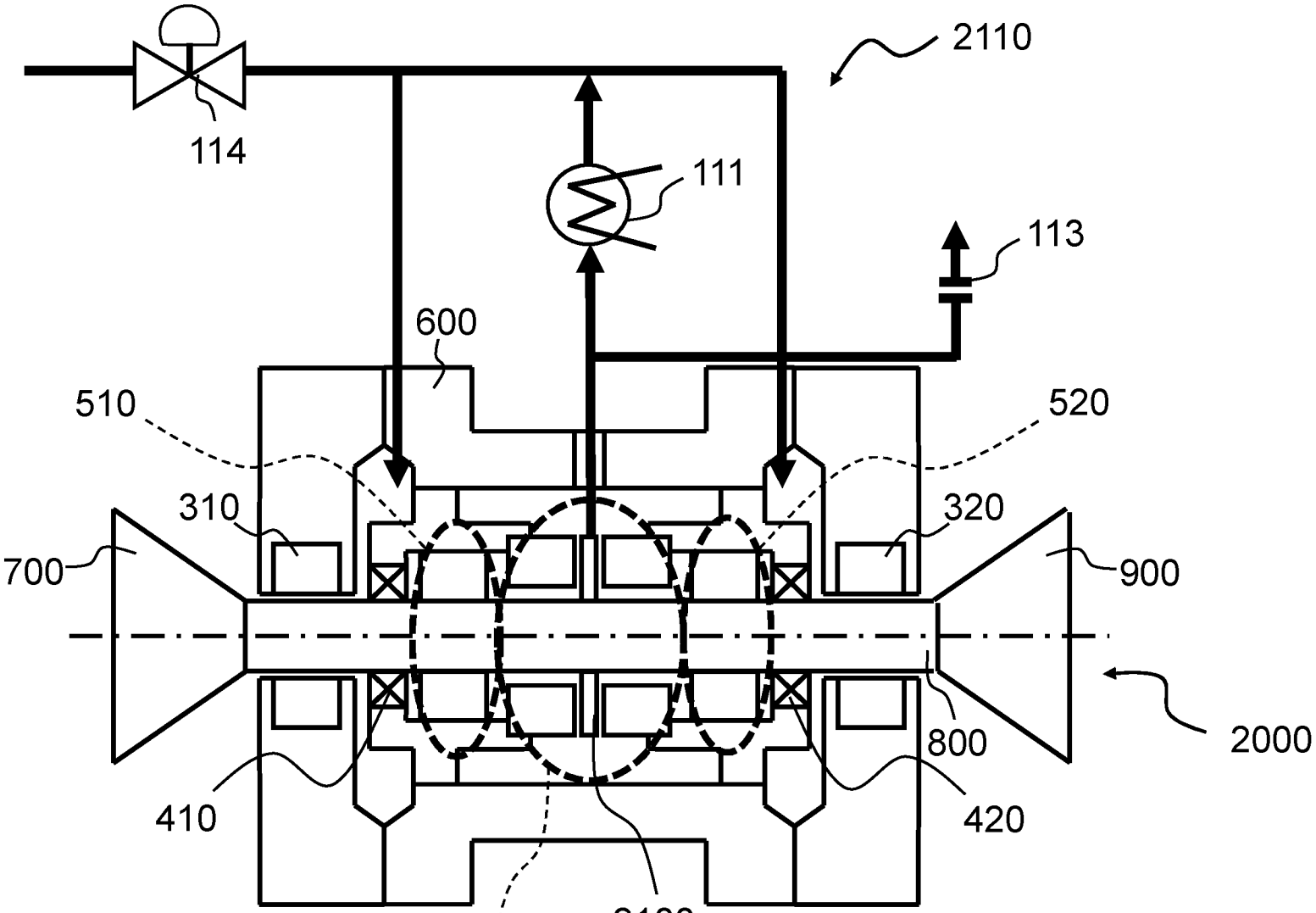
FIG. 2 shows a simplified cross-sectional view of a second embodiment of an innovative expander-compressor system wherein an external part of a cooling fluid circuit is highlighted.
Figure 3:
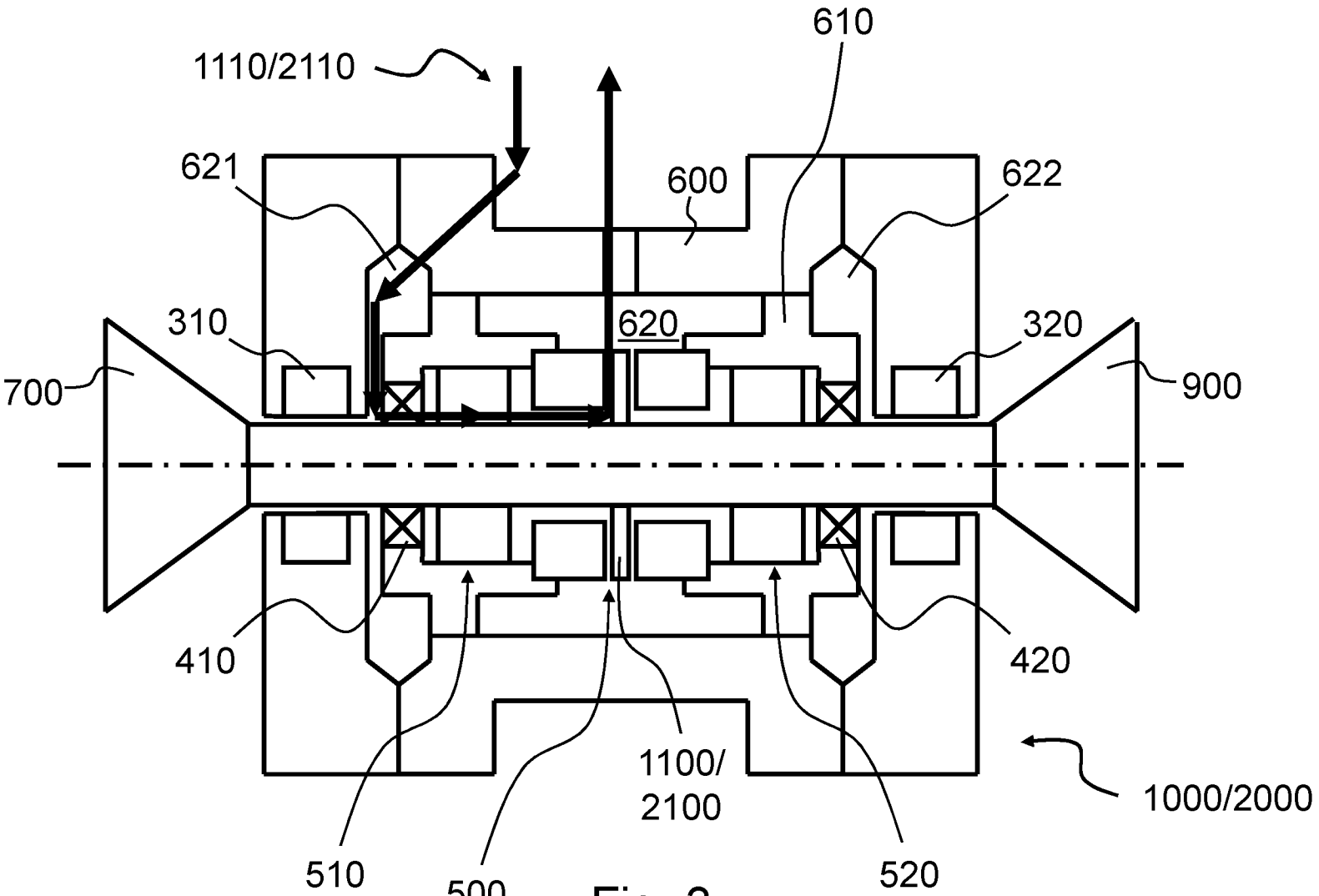
FIG. 3 shows a simplified cross-sectional view of an innovative expander-compressor system wherein an internal part of a cooling fluid circuit is partially highlighted.

In FIGS. 1 and 2 are schematically shown two embodiments of an innovative expander-compressor system. The innovative expander-compressor system is generally indicated with reference numeral 1000 in FIGS. 1 and 2000 in FIG. 2. FIG. 3 wherein an internal part of a cooling fluid circuit is highlighted and applies to the cooling fluid circuit of the embodiments of both FIG. 1 and FIG. 2.

Typically, with non-limiting reference to FIG. 1, FIG. 2 and FIG. 3, the expander-compressor system 1000, 2000 has an expander 700 configured to expand a process gas, a compressor 900 configured to compress a process gas, and a shaft 800 which mechanically couples together the expander 700 and the compressor 900. The expander 700 is positioned at a first end of the shaft 800 and the compressor 900 is positioned at a second end of the shaft 800. It is to be noted that the process gas to be expanded (expander process gas) and the process gas to be compressed (compressor process gas) may be the same process gas or different process gases.

The expander-compressor system 1000, 2000 has further a casing 600 which houses at least the shaft 800. It is to be noted that the expander 700 and the compressor 900 are not housed in the casing 600; in particular, the casing 600 is configured to isolate mechanical components and fluids that are inside the casing 600 from the surrounding environment, for example from the expander 700 and the compressor 900. In other words, the compressor 900 and the expander 700 are positioned outside the casing 600.

Considering FIG. 1, FIG. 2 and FIG. 3, the expander-compressor system 1000, 2000 comprises further at least one magnetic bearing arranged to act on the shaft 800; in these figures three magnetic bearings 500, 510, 520 are shown. According to the preferred embodiments shown in the figures, the expander-compressor system is provided with an axial thrust magnetic bearing 500, which is arranged on the shaft 800 preferably substantially centrally with respect to the expander 700 and to the compressor 900; in particular, the axial thrust magnetic bearing 500 is arranged to act on the shaft 800 at a central section of the shaft 800. The expander-compressor system 1000, 2000 comprises further a radial magnetic bearing preferably two radial magnetic bearings 510 and 520 which are arranged on the shaft 800 preferably at a first end section of the shaft 800 and at a second end section of the shaft 800. In particular, an end section of the shaft 800 is a section at the first end or the second end of the shaft 800.

Figure 4:
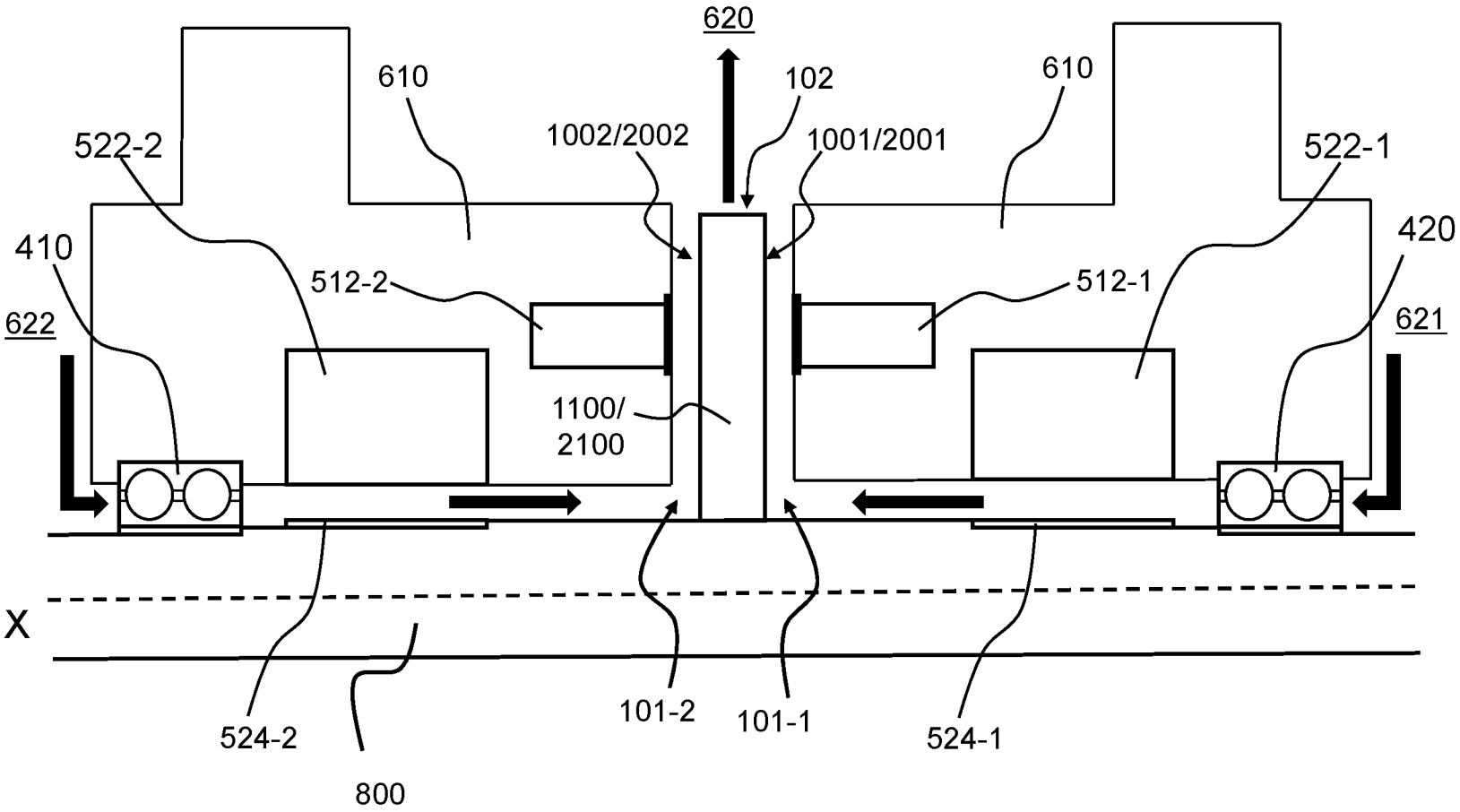
FIG. 4 shows a detailed cross-sectional view of a portion of the internal part of the cooling fluid circuit of FIG. 3.

Advantageously, the magnetic bearings 500, 510, 520 have a stator mechanically coupled or integral with the casing 600 and/or a rotor mechanically coupled or integral with the shaft 800. For example, as shown in FIG. 4, the stators 522-1 and 522-2 of the radial magnetic bearings 510 and 520 and the stators 512-1 and 512-2 of the axial thrust magnetic bearing 500 are coupled to a section 610 of the casing 600; in particular, the section 610 of the casing 600 is an internal section of the casing 600. Advantageously, the radial magnetic bearings 510 and 520 have also a rotary ring 524-1 and 524-2 coupled to the shaft 800 of the expander-compressor system 1000, 2000 and/or the axial thrust magnetic bearing 500 has a (rotary) thrust disk 1100, 2100 coupled to the shaft 800 of the expander-compressor system 1000, 2000.

According to preferred embodiments (see e.g. FIG. 3), a first radial magnetic bearing 510 is arranged between the expander 700 and the thrust magnetic bearing 500 and a second radial magnetic bearing 520 is arranged between the compressor 900 and the thrust magnetic bearing 500. In other words, the magnetic bearings 500, 510, 520 are positioned inside the casing 600, between the first end and the second end of the shaft 800.

Advantageously, the expander-compressor system 1000, 2000 further comprises a rotating bodies bearing; preferably, the expander-compressor system 1000, 2000 comprises two rotating bodies bearings 410 and 420, a first rotating bodies bearing 410 positioned between the expander 700 and the first radial magnetic bearing 510 and a second rotating bodies bearing 420 positioned between the compressor 900 and the second radial magnetic bearing 520. Preferably, the rotating bodies are made of ceramic material. It is to be noted that rotating bodies bearing typically comes into use in the case that the load on the magnetic bearings exceeds their capacity or in the case of failure of the magnetic bearing system while it is not used during normal operation of the expander-compressor system 1000, 2000. In fact, the life these rotating bodies bearings is very limited in time as the ceramic rotating bodies may quickly wear out and reduce in size. In other words, rotating bodies bearings typically acts as safety bearings of the system.

As it will be apparent from the following, the expander-compressor system 1000, 2000 further comprises at least one dry gas seal 310, 320 arranged at the casing around the first end of the shaft and/or the second end of the shaft; preferably, the expander-compressor system 1000, 2000 has two dry gas seals 310 and 320: the first dry gas seal 310 arranged at the casing 600 around the first end of the shaft 800, in particular between the expander 700 and the radial magnetic bearing 510, more preferably between the expander 700 and the first rotating bodies bearing 410, and the second dry gas seal 320 arranged at the casing 600 around the second end of the shaft 800, in particular between the compressor 900 and the radial magnetic bearing 520, more preferably between the compressor 900 and the second rotating bodies bearing 420. Advantageously, the dry gas seals 310 and 320 are configured to provide sealing within the casing 600 on a first side of the dry gas seal, in particular a first side towards the expander 700 or compressor 900, through a flow of a process gas, in particular an expander process gas or a compressor process gas, and on a second side of the dry gas seal, in particular a second side towards the inside of the casing 600, through a flow of a seal gas, in particular nitrogen gas.

With non-limiting reference to FIG. 1, FIG. 2 and FIG. 3, the expander-compressor system 1000, 2000 comprises also a cooling fluid circuit 1110, 2110 arranged to cool the at least one magnetic bearing preferably all the magnetic bearings 500, 510, 520. The cooling fluid circuit 1110, 2110 comprises a pump or a blower configured to circulate a cooling fluid (for example element 112 of the first embodiment in FIG. 1 and element 2100 of the second embodiment in FIG. 2 has this function). The cooling fluid circuit 1110, 2110 comprises also a heat exchanger 111, which is positioned outside the casing 600, configured to remove heat from the cooling fluid of the cooling fluid circuit 1110, 2110. The cooling fluid circuit 1110, 2110 is arranged in a closed-loop configuration such that the cooling fluid enters into the casing 600, cools at least one of the magnetic bearings 500, 510, 520 (possibly other components), exits from the casing 600, is cooled by the heat exchanger 111 and returns to the casing 600.

According to the first embodiment shown in FIG. 1, the pump or blower 112 is configured to provide a pumping effect on the cooling fluid; in other words, the blower 112 is configured to pump the cooling fluid in the cooling fluid circuit 1110; advantageously, the blower 112 is positioned outside the casing 600; more advantageously, the blower 112 is arranged downstream the heat exchanger 111; even more advantageously, the blower 112 is powered by a dedicated motor, in particular an electric motor.

According to the second embodiment shown in FIG. 2 the axial thrust magnetic bearing 500 comprises a thrust disk 2100 having a plurality of grooves at least on a first side 2001 of the thrust disk 2100, preferably on both sides 2001, 2002 of the thrust disk 2100, and/or a plurality of blades at an outer periphery of the thrust disk 2100. The grooves and/or the blades are configured to provide a pumping effect on the cooling fluid; in other words, the grooves and/or the blades are configured to circulate the cooling fluid in the cooling fluid circuit 2110 so that the axial thrust magnetic bearing integrates the pump or blower internally to the casing 600.

According to other embodiments not shown in the figures, there may be both an internal pump or blower and an external pump or blower.

In FIG. 5A, FIG. 5B, FIG. 6A and FIG. 6B are schematically shown two embodiments of the thrust disk 2100 (see FIG. 2) of the innovative expander-compressor system 2000 according to the present disclosure.

Figure 5B:
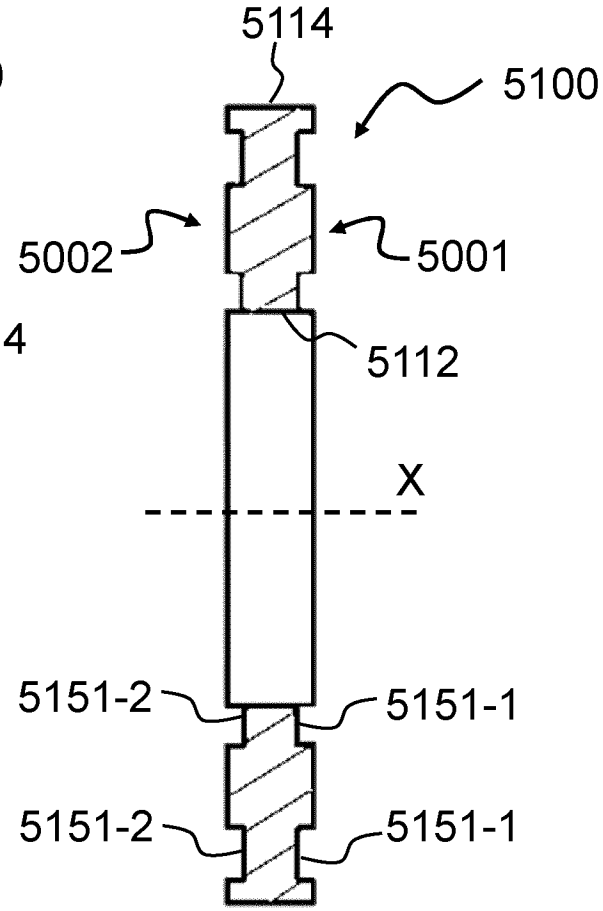
FIG. 5 shows a first embodiment of a thrust magnetic bearing of the innovative expander-compressor system of FIG. 2.
Figure 5A:
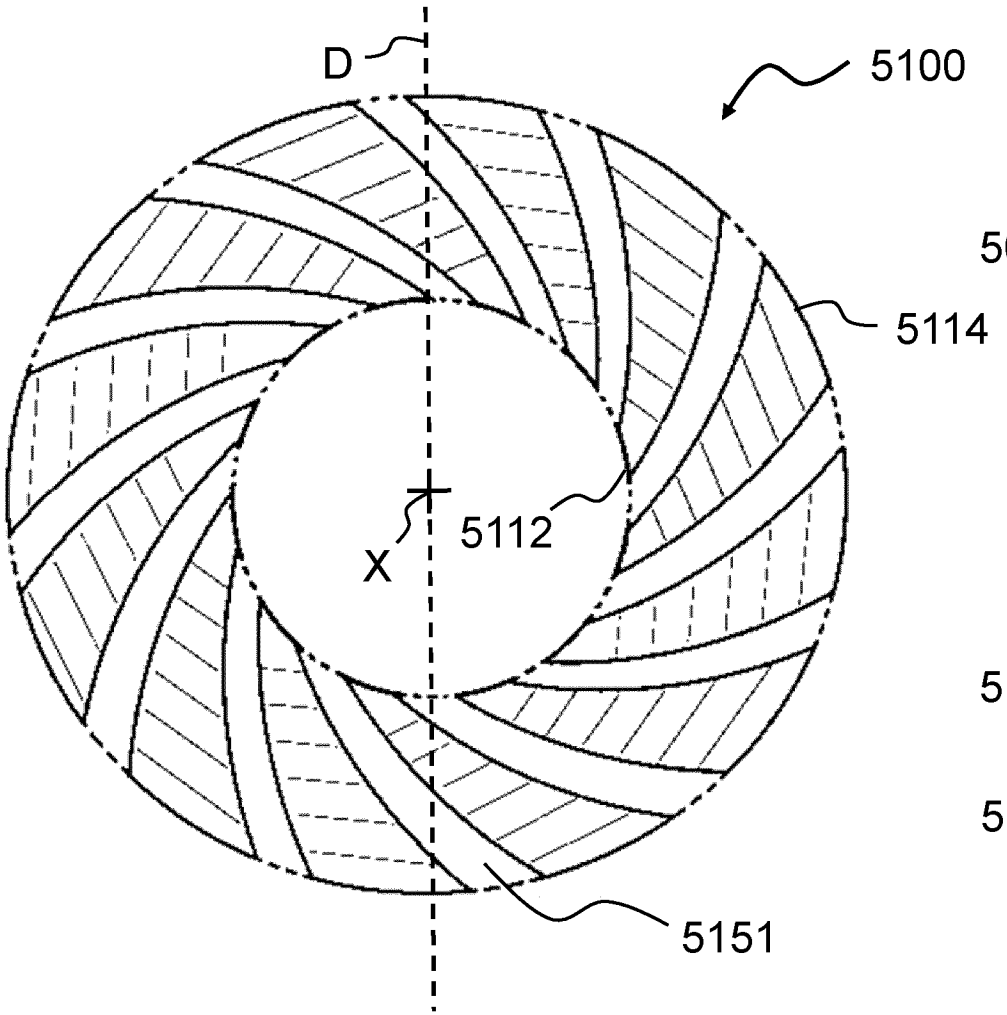

FIGS. 5A and 5B partially show, for example and without limitation, a first embodiment of a thrust disk, labelled as 5100, comprising a plurality of grooves configured to pump the fluid. FIG. 5A is a frontal schematic view of the thrust disk 5100 and FIG. 5B is a cross-section schematic view of the thrust disk 5100 of FIG. 5A taken along the dotted line D.

Figure 6B:
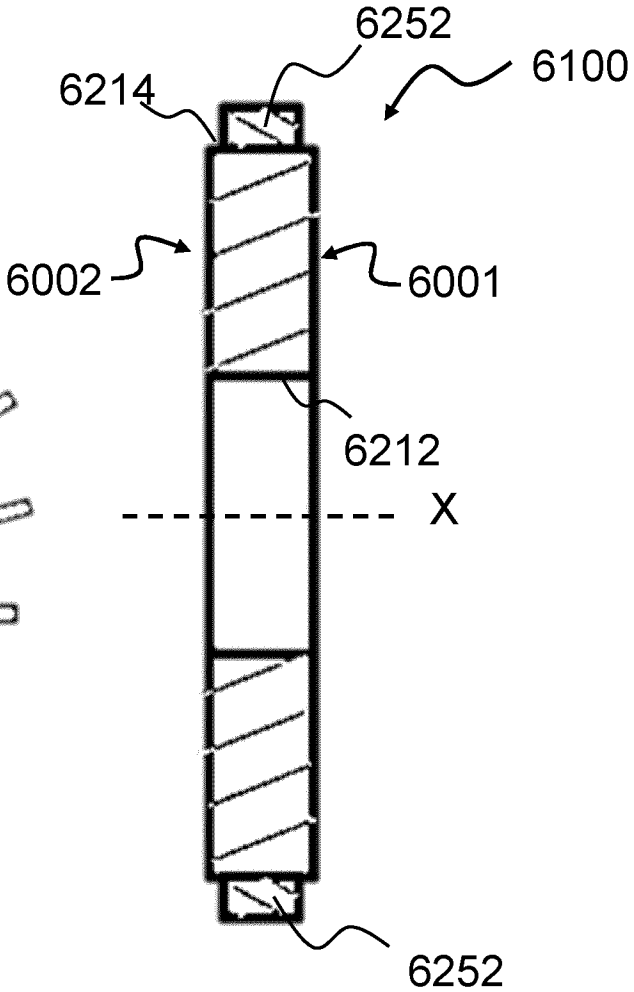
FIG. 6 shows a second embodiment of a thrust magnetic bearing of the innovative expander-compressor system of FIG. 2.
Figure 6A:
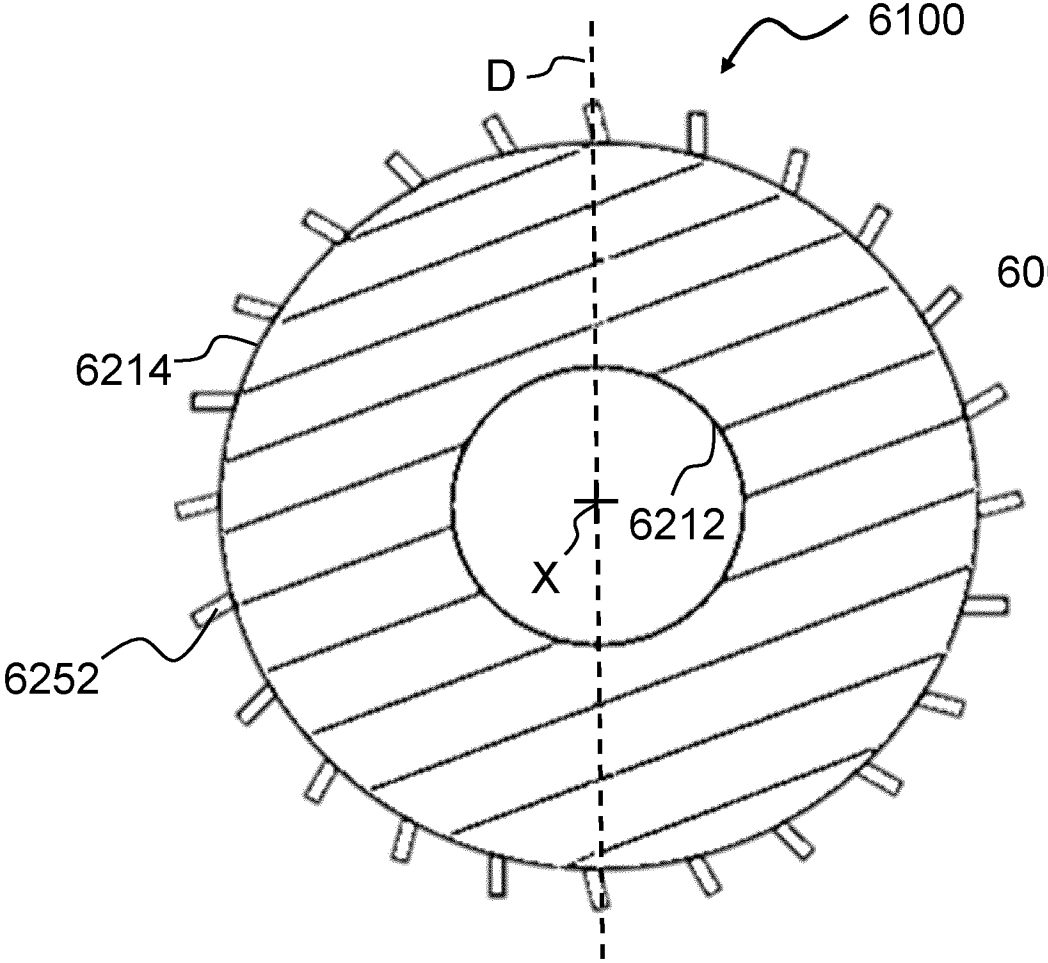

FIGS. 6A and 6B partially shows, for example and without limitation, a second embodiment of a thrust disk, labelled as 6100, comprising a plurality of grooves configured to pump the fluid. FIG. 6A is a frontal schematic view of the thrust disk 6100 and FIG. 6B is a cross-section schematic view of the thrust disk 6100 of FIG. 6A taken along the dotted line D.

According to the first embodiment, at least the first side 5001 of the thrust disk 5100 comprises a plurality of grooves 5151-1 configured to pump the fluid as a result of the rotation of the thrust disk 5100 of the axial thrust magnetic bearing 500. In a preferred embodiment (see FIG. 5B), the thrust disk 5100 comprises a plurality of grooves 5151-1 on the first side 5001 and a plurality of grooves 5151-2 on the second side 5002, the grooves 5151-1 and 5151-2 being configured to pump the fluid as a result of the rotation of the thrust disk 5100 of the thrust magnetic bearing 500.

Advantageously, as shown in FIG. 5A and FIG. 5B, the grooves 5151 extend from an area around the inner periphery 5112 of the thrust disk 5100 to an area around the outer periphery 5114 of the thrust disk 5100; in particular the grooves 5151 extend continuously from an area around the inner periphery 5112 of the thrust disk 5100 to an area around the outer periphery 5114 of the thrust disk 5100.

Advantageously, the grooves 5151 are curved-shaped; more advantageously, the grooves 5151 are configured to define a preferential direction which may be followed by the cooling fluid. It is to be noted that the width and/or the depth of the grooves 5151 may not be constant: for example, the width at the area around the inner periphery 5112 may be greater than the width at the area around the outer periphery 5114. Advantageously, if the thrust disk 5100 has grooves 5151 both on the first side 5001 and second side 5002, the geometry of the grooves 5151 is preferably the same both on the first side 5001 and on the second side 5002 of the thrust disk 5100.

Advantageously, the cooling fluid enters the axial thrust magnetic bearing 500 in order to cool it down; in particular, the cooling fluid flows on the thrust disk 5100 from the area around the inner periphery 5112 to the area around the outer periphery 5114. More advantageously, most part of the fluid that flows on the thrust disk 5100 is configured to flow in the preferential direction defined by the grooves 5151; in other words, the fluid is guided to flow along the grooves 5151 so that, with the rotation of the thrust disk 5100 due to the rotation of the shaft 800, the grooves 5151 are configured to pump the cooling fluid. It is to be noted that only the cooling fluid that flows along the grooves 5151 is subjected to the pumping effect of the thrust disk 5100, while the cooling fluid that flows outside the grooves 5151 is not subjected to any pumping effect.

According to the second embodiment shown in FIGS. 6, the thrust disk 6100 comprises a plurality of blades 6252 at the outer periphery 6214 configured to pump the fluid as a result of the rotation of the thrust disk 6100 of the axial thrust magnetic bearing 500. The blades 6252 may be obtained directly from the thrust disk 6100, by machining of the disk, or may be mounted on the thrust disk 6200 by welding or joining. It is to be noted that if blades 6252 are mounted on the thrust disk 6100, they can be made of different material from the one of the thrust disk 6100; for example, blades 6252 may be made of composite materials. It is also to be noted that, if blades 6252 are added by joining, known joint can be used. Preferably, the blades 6252 are mounted on the thrust disk 6100 by dovetail coupling.

Advantageously, the blades 6252 are smaller than the thrust disk 6100; in particular, a height of the blades 6252 might be in the range 5-15% of the diameter of the thrust disk 6100 (measured at the outer periphery 6214). Advantageously, a width of the blades 6252 is less than or equal to the thickness of the thrust disk 6100; preferably, the width of the blades 6252 is 70-100% of the thickness of the thrust disk 6100.

It is to be noted that the blades 6252 may have a blade profile with two concavities, for example to make the pumping effect on the fluid more effective and/or to help collect fluid at the thrust disk outlet; in particular, the blades 6252 may have a first concavity oriented toward the first side 6001 and a second concavity oriented towards the second side 6002; preferably, the first and the second concavities of the blades 6252 form a central ridge of the blade profile.

As explained above, with non-limiting reference to FIG. 1, FIG. 2 and FIG. 3, the expander-compressor system 1000, 2000 has a cooling fluid circuit 1110, 2110 in which flows a cooling fluid. In particular, the cooling fluid circuit 1110, 2110 is arranged such that the cooling fluid enters into the casing 600 partially at a first side and partially at a second side, for example through two flanges which fluidly connects a portion of the cooling fluid circuit 1110, 2110 outside the casing 600 with a first side inner chamber 621 and a second side inner chamber 622 of the casing 600. Advantageously, the first side inner chamber 621 is positioned at a first end of the casing, where the expander 700 is located, in particular between the dry gas seal 310 and the rotating bodies bearing 410, and the second side inner chamber 622 is positioned at a second end of the casing, where the compressor 900 is located, in particular between the dry gas seal 320 and the rotating bodies bearing 420.

According to the preferred embodiments shown for example in FIG. 1 and FIG. 2 (see also FIG. 4), the cooling fluid circuit 1110, 2110 is configured to cool the two radial magnetic bearings 510, 520 in parallel. In particular, the cooling fluid enters into the casing 600 and cools the radial magnetic bearings 510, 520 in parallel, in particular flowing in the gap between the stator 522 and the rotor 524 of the magnetic bearings 510, 520. For example, the cooling fluid flows from the first and second side inner chambers 621 and 622 to the radial bearings 510 and 520, passing first through the rotating bodies bearings 410 and 420 and then through a gap between the shaft 800 and the section 610 of the casing 600 (including the radial bearings 510 and 520).

In particular, a first part of the cooling fluid enters in the side inner chamber 621 and a second part of the cooling fluid enters in the second side inner chamber 622; advantageously, the first part and the second part of the cooling fluid have substantially the same flow rate; more advantageously, the flow rates of the first part and the second part of the cooling fluid are substantially equal to the half of the total flow rate circulating in the cooling fluid.

Once that the cooling fluid has passed through the gap and has cooled the radial magnetic bearings 510, 520, it reaches the axial thrust magnetic bearing 500. In particular, the axial thrust magnetic bearing 500 receives the first part of the cooling fluid from a first inlet 101-1 at a first side 1001, 2001 of the thrust disk 1100, 2100 and the second part of the cooling fluid from a second inlet 101-2 at a second side 1002, 2002 of the thrust disk 1100, 2100, so that the first part of the cooling fluid is configured to cool down the first side 1001, 2001 of the thrust disk 1100, 2100, in particular a first half of the thrust disk 1100, 2100, and the second part of the cooling fluid is arranged to cool down the second side 1002, 2002 of the thrust disk 1100, 2100, in particular a second half of the thrust disk 1100, 2100. Advantageously, the axial thrust magnetic bearing 500 is arranged so that the cooling fluid enters the axial thrust magnetic bearing 500 through the first and the second inlets 101-1 and 101-2, passes through the gap between the section 610 of the casing 600 (including the stator 512) and the thrust disk 1100, 2100 and exits the axial thrust magnetic bearing 500 through the outlet 102.

According to the preferred embodiments shown for example in FIG. 1 and FIG. 2, the cooling fluid circuit 1110, 2110 is configured to cool at least two magnetic bearings in series (for example bearings 500 and 510 as well as bearings 500 and 520—it is to be noted that bearings 510 and 520 are also cooled in parallel). For example, with non-limiting reference to FIG. 3, the cooling fluid circuit 1110, 2110 is configured to cool first the radial magnetic bearing 510 and then the axial thrust magnetic bearing 500. Advantageously, the cooling fluid circuit 1110, 2110 is also configured to cool first the radial magnetic bearing 520 and then the axial thrust magnetic bearing 500.

Considering FIG. 3 and FIG. 4, the cooling fluid of the cooling fluid circuit 1110, 2110, after having cooled the axial thrust magnetic bearing 1100, 2100 exits from the casing 600 entirely in a central region. In particular, the casing 600 comprises a central inner chamber 620 and the cooling fluid circuit 1110, 2110 is arranged so that the cooling fluid exits from the axial thrust magnetic bearing 500, in particular at the outlet 102, flows through the central inner chamber 620 and exits from the central inner chamber 620, in particular through a flange which fluidly connects the portion of the cooling fluid circuit 1110, 2110 outside the casing 600 with the central inner chamber 620. Preferably, the cooling fluid exits from the outlet 102 of the axial thrust magnetic bearing 500 and/or the casing 600 in radial direction.

With non-limiting reference to FIG. 1 and FIG. 2, the cooling fluid circuit 1110, 2110 comprises further a valve 114 which is fluidly coupled to a cooling fluid inlet, for example from a cooling fluid storage; in particular, the valve 114 is configured to selectively feed the cooling fluid from the cooling fluid inlet to the cooling fluid circuit 1110, 2110: the cooling fluid enters in the cooling fluid circuit 1110, 2110 when the valve 114 is opened, while the cooling fluid inlet and the cooling fluid circuit 1110, 2110 are decoupled when the valve 114 is closed (i.e. the cooling fluid cannot enter in the cooling fluid circuit 1110, 2110 when the valve 114 is closed). Advantageously, the valve 114 is most of the time closed.

Advantageously, the cooling fluid is instrument air or nitrogen or other inert gas. It is also to be noted that the temperature of the cooling fluid entering the casing 600 and of the cooling fluid exiting from the casing 600 is different; in particular, the temperature of the cooling fluid entering the casing 600 is lower than the temperature of the cooling fluid exiting from the casing 600; for example, the difference between the temperature of the cooling fluid entering the casing 600 and exiting from the casing 600 may be in the range of 20° C.-50° C.

Figure 7:
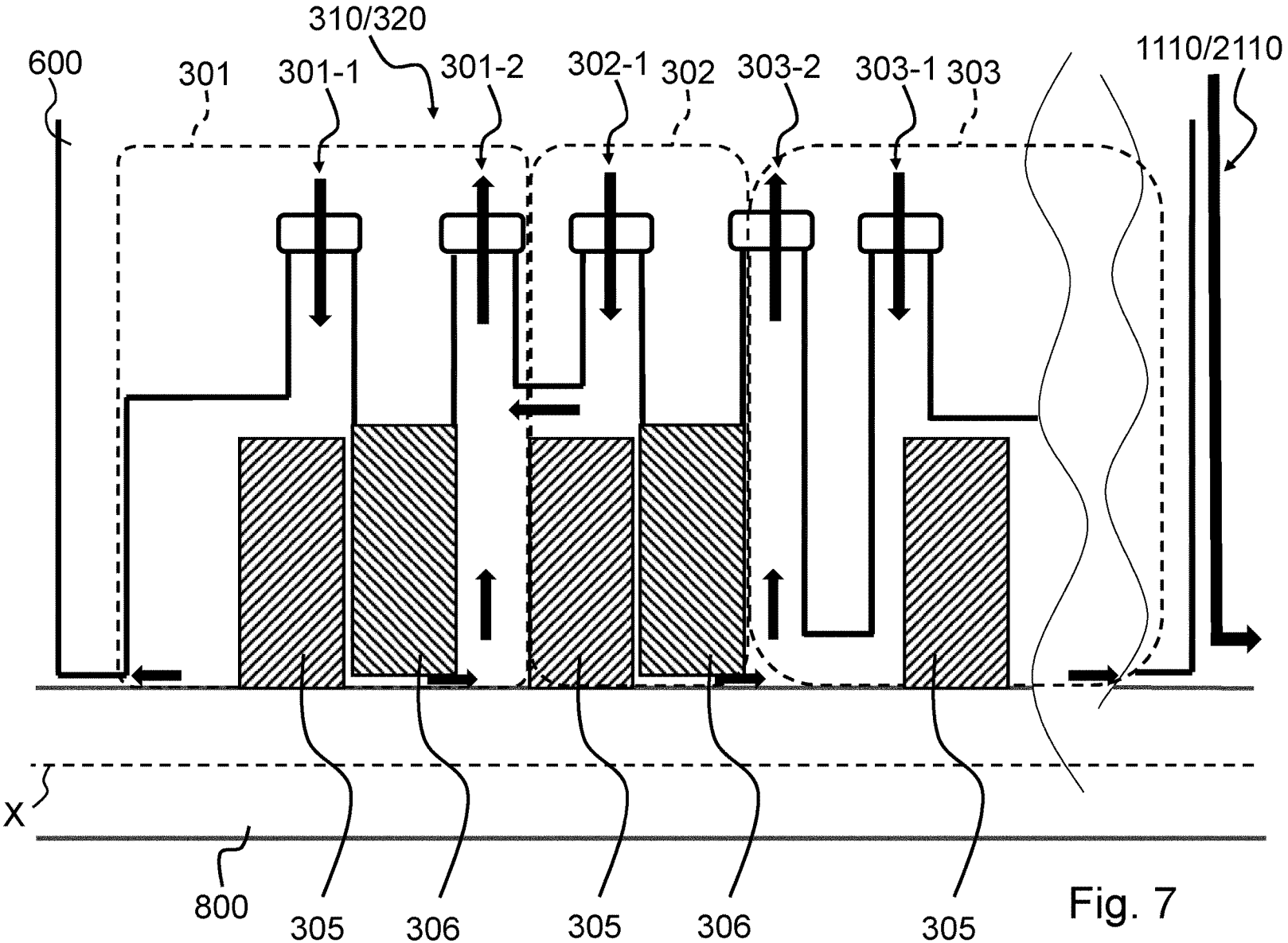
FIG. 7 shows a detailed cross-sectional view of an embodiment of a dry gas seal that may be used in an innovative expander-compressor system, for example the system of FIG. 1 or the system of FIG. 2.

As already explained, the expander-compressor system 1000, 2000 may comprise at least one dry gas seal (=DGS), preferably two dry gas seals 310 and 320 (see e.g. FIG. 7). Typically, dry gas seals are applied to rotary machines to prevent any gas leakage; the at least one dry gas seal 310 and 320 is configured to prevent leakage of process gas from the expander 700 or the compressor 900 to the cooling fluid circuit 1110 and 2110. In particular, the dry gas seals 310 and 320 are configured to avoid leakage of process gas to the cooling fluid circuit 1110 and 2110 which may occur at the shaft 800 due to mechanical gap required to allow shaft rotation (see e.g. FIG. 1 and FIG. 2). Advantageously, dry gas seals 310 and 320 are arranged around the shaft 800.

Considering FIG. 7, the dry gas seal 310 and/or 320 may be conceptually divided into three sections, each section comprising a stationary ring 306 and a rotating ring 305, where the rotating ring 305 is mechanically coupled to the shaft 800 of the expander-compressor system 1000, 2000 and the stationary ring 306 is coupled to the casing 600. Advantageously, a first section 301 is positioned at the expander 700 or the compressor 900, a third section 303 is positioned at the first side inner chamber 621 or at the second side inner chamber 622 and a second section 302 is positioned between the first section 301 and third section 303. Advantageously, the first section 301 has an inlet 301-1 wherein process gas, in particular expander process gas or compressor process gas, is injected, in such a way that it generates a fluid-dynamic force causing the stationary ring 306 to separate from the rotating ring 305. Preferably, the casing 600 has a dedicated duct for the passage of the process gas which is connected to the inlet 301-1. Advantageously, the second section 302 has an inlet 302-1 wherein a first injection of seal gas, preferably nitrogen, is injected. Preferably, the casing 600 has a dedicated duct for the passage of the seal gas which is connected to the inlet 302-1. As shown in FIG. 7 (see the black arrows of the second section 302), part of the seal gas of the second section 302 may leakage to the first section 301 and blending with the process gas. Advantageously, the first section 301 has also an outlet 301-2 through which the blending of process gas and seal gas can exit. Advantageously, the third section 303 has an inlet 303-1 wherein a second injection of seal gas, preferably nitrogen, is injected. Preferably, the casing 600 has a dedicated duct for the passage of the seal gas which is connected to the inlet 303-1. As schematically and partially shown in FIG. 7 (see the black arrows of the third section 303), part of the seal gas of the third section 303 may leakage to the cooling fluid circuit 1110, 2110. It is also to be noted that part of the seal gas of the second section 302 may leakage to the third section 303. Advantageously, the third section 303 has also an outlet 303-2 through which the seal gas can exit. It is to be noted that on right of FIG. 7 there is a portion of the dry gas seal 310, 320 that has been omitted; this portion may include components that are not relevant of the subject matter disclosed herein or may be similar to the portion on the left of FIG. 7.

In other words, the dry gas seals 310 and 320 prevent leakage of process gas inside the casing 600, in particular into the cooling fluid circuit 1110, 2110. However, a small part of the seal gas may leakage into the cooling fluid circuit 1110, 2110, for example 1 Nl/min.

In order to avoid pressurization of the cooling fluid circuit 1110, 2110, the expander-compressor system 1000, 2000 advantageously comprises further a vent 113, in particular a calibrated orifice, which is configured to discharge fluid from the cooling fluid circuit 1110, 2110, in particular to discharge fluid partially coming from the dry gas seal 310 and 320. In other words, in the cooling fluid circuit 1110 and 2110 may circulate cooling fluid and a small portion of extra fluid which is a leakage of seal gas from the dry gas seal 310 and 320 to the cooling fluid circuit 1110, 2110. Advantageously, the orifice is calibrated so that the amount of fluid discharged by the vent 113 is equal to the amount of extra fluid that is leaked in the cooling fluid circuit 1110, 2110.

The invention claimed is:

1. An expander-compressor system for circulating a process gas, comprising:

an expander configured to expand the process gas;

a compressor configured to compress the process gas;

a shaft mechanically coupling the expander and the compressor;

a casing housing the shaft;

a dry gas seal arranged at the casing around a first end of the shaft or a second end of the shaft;

at least one magnetic bearing acting on the shaft;

a cooling fluid circuit for cooling the at least one magnetic bearing through circulation of a cooling fluid, the cooling fluid circuit comprising a heat exchanger configured to remove heat from the cooling fluid;

wherein the dry gas seal is configured to avoid leakage of the process gas to the cooling fluid circuit at the shaft, wherein the dry gas seal comprises a stationary ring and a rotating ring, wherein the stationary ring is mechanically coupled to the casing, wherein the rotating ring is mechanically coupled to the shaft, wherein the at least one magnetic bearing is positioned inside the casing, wherein the heat exchanger, the compressor, and the expander are positioned outside the casing, wherein the compressor and the expander are disposed on opposite ends to the casing, and wherein the cooling fluid circuit is spaced apart from each of the compressor and the expander and arranged in a closed-loop configuration that cools the at least one magnetic bearing, exits from a first side of the casing, is cooled by the heat exchanger, and then re-enters the first side of the casing.

2. The expander-compressor system of claim 1, wherein the expander is positioned at the first end of the shaft and the compressor is positioned at the second end of the shaft, wherein the cooling fluid circuit comprises a pump or a blower configured to circulate the cooling fluid, wherein the at least one magnetic bearing is positioned in the casing between the expander and the compressor.

3. The expander-compressor system of claim 2, wherein the axial thrust magnetic bearing comprises a thrust disk comprises:

a plurality of grooves at least on a first side of the thrust disk, on both sides of the thrust disk, or a plurality of blades at an outer periphery of the thrust disk, wherein the plurality of grooves or the plurality of blades are configured to circulate the cooling fluid in the cooling fluid circuit thereby the axial thrust magnetic bearing integrates the pump or the blower internally to the casing.

4. The expander-compressor system of claim 2, wherein the pump or blower is positioned outside the casing.

5. The expander-compressor system of claim 1, wherein the at least one magnetic bearing is an axial thrust magnetic bearing arranged on the shaft substantially centrally with respect to the expander and to the compressor.

6. The expander-compressor system of claim 1, wherein the at least one magnetic bearing is a radial magnetic bearing arranged on the shaft at a first end section of the shaft or at a second end section of the shaft.

7. The expander-compressor system of claim 1, wherein the cooling fluid circuit is configured to cool at least two magnetic bearings in series.

8. The expander-compressor system of claim 1, wherein the cooling fluid circuit is configured to cool at least two magnetic bearings in parallel.

9. The expander-compressor system of claim 1, wherein the cooling fluid circuit comprises further a valve, wherein the valve is fluidly coupled to a cooling fluid inlet, and wherein the valve is configured to selectively feed the cooling fluid from the cooling fluid inlet to the cooling fluid circuit.

10. The expander-compressor system of claim 1, wherein the at least one magnetic bearing comprises:

an axial thrust magnetic bearing positioned inside the casing arranged to act on the shaft at a central section of the shaft, a first radial magnetic bearing positioned inside the casing arranged to act on the shaft at a first end section of the shaft, a second radial magnetic bearing positioned inside the casing arranged to act on the shaft at a second end section of the shaft, and wherein the cooling fluid circuit is arranged such that the cooling fluid:

enters into the casing partially at a first side and partially at a second side, cools the first radial magnetic bearing and the second radial magnetic bearing, cools the axial thrust magnetic bearing, and exits from the casing entirely at a central region.

11. The expander-compressor system of claim 10, wherein the casing comprises a central inner chamber, wherein the cooling fluid circuit is arranged so that the cooling fluid:

exits from the axial thrust magnetic bearing, flows through the central inner chamber, and exits from the central inner chamber.

12. The expander-compressor system of claim 10, wherein the casing comprises a first side inner chamber and a second side inner chamber, wherein the cooling fluid circuit is arranged so that a first part of the cooling fluid flows through the first side inner chamber before cooling the first radial magnetic bearing, and wherein the cooling fluid circuit is arranged so that a second part of the cooling fluid flows through the second side inner chamber before cooling the second radial magnetic bearing.

13. The expander-compressor system of claim 1, wherein the system comprises a rotating bodies bearing, the rotating bodies comprising ceramic material, and wherein the cooling fluid circuit is arranged so that the cooling fluid flows through the rotating bodies bearing.

14. The expander-compressor system of claim 1, wherein the dry gas seal is configured to provide sealing on a first side through a flow of the process gas and on a second side through a flow of a seal gas.

15. The expander-compressor system of claim 1, wherein the cooling fluid circuit comprises a vent, wherein the vent is configured to discharge fluid from the cooling fluid circuit, and wherein fluid from the cooling fluid circuit comes partially from the dry gas seal.

* * * * *